US007896455B2

(12) United States Patent
Matsui et al.

(10) Patent No.: US 7,896,455 B2
(45) Date of Patent: Mar. 1, 2011

(54) ELEMENT SUBSTRATE, AND PRINTHEAD, HEAD CARTRIDGE, AND PRINTING APPARATUS USING THE ELEMENT SUBSTRATE

(75) Inventors: Takahiro Matsui, Yokohama (JP); Yoshiyuki Imanaka, Kawasaki (JP); Takuya Hatsui, Tokyo (JP); Souta Takeuchi, Yokohama (JP); Takaaki Yamaguchi, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/828,626

(22) Filed: Jul. 1, 2010

(65) Prior Publication Data

US 2010/0265299 A1 Oct. 21, 2010

Related U.S. Application Data

(63) Continuation of application No. 11/867,976, filed on Oct. 5, 2007, now Pat. No. 7,770,989.

(30) Foreign Application Priority Data

Oct. 31, 2006 (JP) ..... 2006-296944

(51) Int. Cl.
*B41J 29/38* (2006.01)
*B41J 2/05* (2006.01)

(52) U.S. Cl. ..... 347/9; 347/10; 347/12; 347/57

(58) Field of Classification Search ..... 347/9, 347/10, 12, 14, 57
See application file for complete search history.

(56) References Cited

U.S. PATENT DOCUMENTS

| | | | | |
|---|---|---|---|---|
| 6,742,874 | B2 | 6/2004 | Hirayama et al. | |
| 2002/0118241 | A1 | 8/2002 | Fujii | |
| 2005/0116975 | A1 | 6/2005 | Kasai | |
| 2005/0231541 | A1 * | 10/2005 | Benjamin | 347/12 |
| 2005/0243128 | A1 * | 11/2005 | Nakajima et al. | 347/41 |
| 2007/0139480 | A1 | 6/2007 | Yamaguchi et al. | |
| 2008/0111864 | A1 | 5/2008 | Yamaguchi et al. | |

FOREIGN PATENT DOCUMENTS

JP 07-068761 A 3/1995

* cited by examiner

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

An element substrate has a plurality of printing elements, and a block selection unit which divides the plurality of printing elements into a plurality of blocks and time-divisionally drives the blocks. The element substrate includes a plurality of input terminals which divide the plurality of printing elements included in each block into a plurality of groups and supply a driving voltage to the printing elements belonging to each group, a delay circuit which externally receives an enable signal for enabling energization to the printing elements and generates a plurality of delayed enable signals having different delay times with respect to the enable signal, and a wiring which supplies the enable signal and the plurality of delayed enable signals output from the delay circuit to different groups in the order of the different delay times.

6 Claims, 14 Drawing Sheets

ELEMENT SUBSTRATE, AND PRINTHEAD, HEAD CARTRIDGE, AND PRINTING APPARATUS USING THE ELEMENT SUBSTRATE

This application is a continuation of application Ser. No. 11/867,976, filed Oct. 5, 2007, the entire disclosure of which is incorporated herein by reference.

BACKGROUND OF THE INVENTION

1. Field of the Invention

The present invention relates to an element substrate which is resistant to operation errors caused by a noise generated based on current fluctuation, capable of stable printing, and particularly suitable for an inkjet printhead, and a printhead, head cartridge, and printing apparatus using the element substrate.

2. Description of the Related Art

An inkjet printhead is conventionally known, which discharges ink from a plurality of discharge orifices using thermal energy. To obtain a stable discharge characteristic in the printhead, it is necessary to apply a stable voltage to heaters. A printhead element substrate has a plurality of heater arrays. When all heaters of a heater array are driven simultaneously, a large current flows to the ground wirings and the driving power supply wirings for supplying power to the heaters, and the voltage considerably drops due to the wiring resistance. If the voltage applied to the heaters varies because of the voltage drop, the ink discharge amount also varies, and a stable discharge characteristic is hard to obtain. To suppress voltage drop and obtain a stable discharge characteristic, a recent printhead element substrate limits the number of heaters to be driven simultaneously. More specifically, heaters are divided into a predetermined number of blocks and sequentially driven using so-called time-divisional driving, thereby applying a stable voltage to the heaters (Japanese Patent Publication Laid-Open No. 07-68761).

As described above, when a plurality of heaters are simultaneously driven, a large current flows to the driving power supply wirings and ground wirings. In this case, a noise generated based on current fluctuation generated by inductive coupling in the TAB wirings of the printhead poses a problem. The TAB wirings are provided on one side from the viewpoint of cost reduction and manufacturing ease of the printhead. Hence, the driving power supply wirings to apply the driving voltage to the heaters on the element substrate, the ground wirings, and logic signal wirings to send a signal to a logic circuit on the element substrate are formed in parallel. Hence, the noise generated by inductive coupling is superimposed on the logic signal. This may cause operation errors of the logic circuit provided on the element substrate. To prevent this, the element substrate using time-divisional driving delays the timings of driving pulses to be applied to heaters in a selected block in the order of nsec. The current flow per unit time is reduced in this way, thereby preventing the noise generation and operation errors of the logic circuit on the element substrate.

In recent inkjet printing apparatuses, discharged ink droplets have increasingly become small for high-quality image formation. Along with improvement of image quality, the printing speed is also required to be higher. However, it is difficult to implement high-speed printing if the discharge ink droplets are small. For example, if the ink discharge amount simply decreases to ½, the number of times of ink discharge must double. Hence, the printing speed decreases to ½.

To prevent the decrease in printing speed caused by small ink droplets, it is necessary to apply the same amount of ink to a print medium in per unit time as before. The decrease in printing speed can be prevented by increasing the number of heaters arranged on the element substrate. However, if only the number of heaters is simply increased without changing their pitch, the element substrate becomes large, and the printhead incorporating the element substrate becomes bulky. The printhead scans in the inkjet printing apparatus at a high speed. Hence, a bulky printhead generates vibration and noise. A bulky printhead also increases cost. To increase the number of heaters without changing the size of the element substrate, a method for increasing the heater arrangement density has been proposed.

When the arrangement density of heaters rises, the number of heaters to be driven simultaneously also increases. When the number of heaters to be driven simultaneously also increases, the current flow per unit time to the driving power supply wirings further increases. For this reason, the conventional delay method using time-divisional driving can hardly suppress a noise generated based on current fluctuation generated by inductive coupling in the TAB wirings of the printhead.

SUMMARY OF THE INVENTION

The present invention is directed to an element substrate, and a printhead, head cartridge, and printing apparatus using the element substrate.

It is possible to provide an element substrate which has printing elements arranged at a high density and prevents operation errors of a logic circuit by suppressing a noise generated based on current fluctuation generated by the rise of a current in driving the printing elements. It is also possible to provide a printhead, head cartridge, and printing apparatus using the element substrate.

According to one aspect of the present invention, preferably, there is provided a printhead element substrate including a plurality of printing elements, and a block selection unit which divides the plurality of printing elements into a plurality of blocks and time-divisionally drives the blocks, comprising:

a plurality of input terminals which divide the plurality of printing elements included in each block into a plurality of groups and supply a driving voltage to the printing elements belonging to each group;

a delay circuit which externally receives an enable signal for enabling energization to the printing elements and generates a plurality of delayed enable signals having different delay times with respect to the enable signal; and a wiring which supplies the enable signal and the plurality of delayed enable signals output from the delay circuit to different groups in the order of the different delay times.

According to another aspect of the present invention, preferably, there is provided a printhead, head cartridge, and printing apparatus having the element substrate.

The invention is particularly advantageous since it is possible to provide an element substrate which has printing elements arranged at a high density and prevents operation errors of a logic circuit by suppressing a noise generated based on current fluctuation generated by the rise of a current in driving the printing elements, and a printhead, head cartridge, and printing apparatus using the element substrate.

Further features of the present invention will become apparent from the following description of exemplary embodiments (with reference to the attached drawings).

DESCRIPTION OF THE EMBODIMENTS

The embodiments of the present invention will be described next with reference to the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

An "element substrate" in the description indicates not a simple substrate made of a silicon semiconductor but a substrate with elements and wirings.

The expression "on an element substrate" indicates not only "on the surface of an element substrate" but also "inside of an element substrate near its surface". The term "built-in" in the present invention indicates not to "simply arrange separate elements on a substrate" but to "integrally form elements on an element substrate in a semiconductor circuit manufacturing process".

[Inkjet Printing Apparatus]

Figure 10:
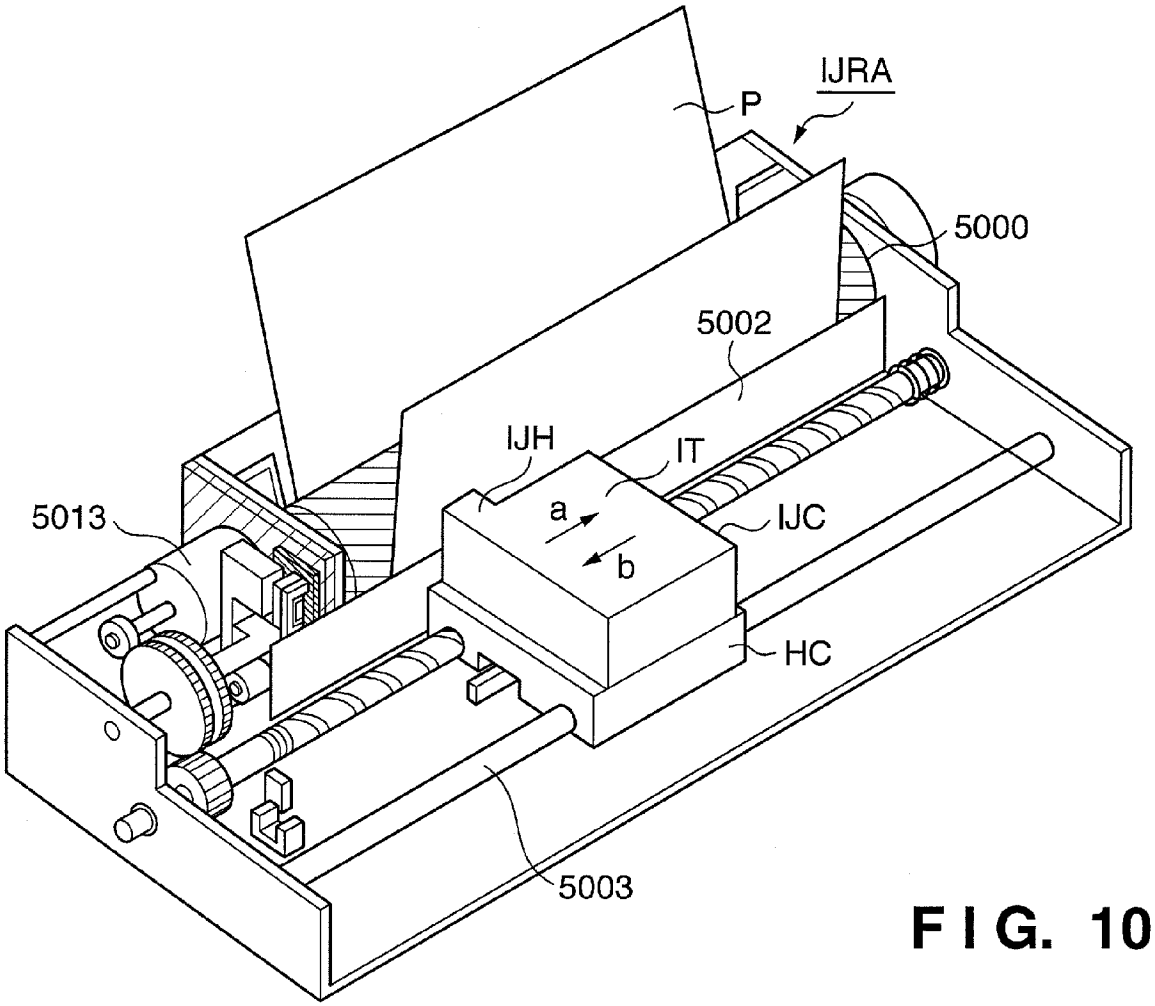
FIG. 10 is an external perspective view showing the schematic arrangement of an inkjet printing apparatus according to a typical embodiment of the present invention.

FIG. 10 is an external perspective view showing the schematic arrangement of an inkjet printing apparatus IJRA according to a typical embodiment of the present invention.

Referring to FIG. 10, a carriage HC reciprocally moves on a guide rail 5003 in the directions of arrows a and b interlockingly with the forward/reverse rotation of a driving motor 5013. An integrated inkjet cartridge (head cartridge) IJC incorporating a printhead IJH and an ink tank IT is mounted on the carriage HC. A paper press plate 5002 presses a print medium P against a platen 5000 in the moving direction of the carriage HC.

[Control Arrangement of Inkjet Printing Apparatus]

A control arrangement for executing print control of the above-described apparatus will be described next.

Figure 11:
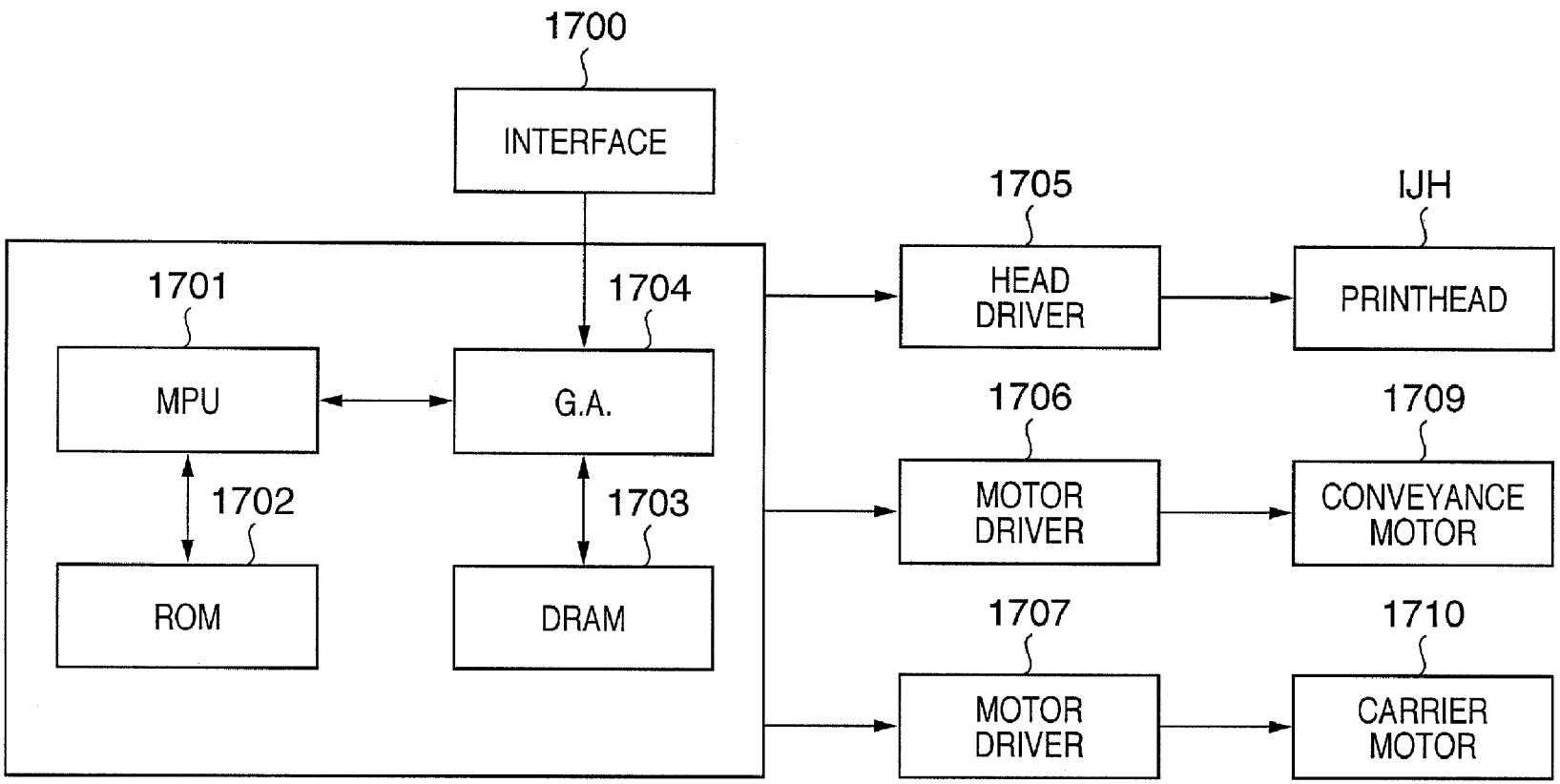
FIG. 11 is a block diagram showing the arrangement of a control circuit of the inkjet printing apparatus according to the embodiment of the present invention.

FIG. 11 is a block diagram showing the arrangement of the control circuit of the printing apparatus IJRA.

Referring to FIG. 11, reference numeral 1700 denotes an interface that inputs a print signal; 1701, an MPU; 1702, a ROM that stores a control program to be executed by the MPU 1701; and 1703, a DRAM that saves various kinds of data (e.g., the print signal and print data to be supplied to the printhead IJH). A gate array (G.A.) 1704 controls print data supply to the printhead IJH and data transfer between the interface 1700, MPU 1701, and RAM 1703. A carrier motor 1710 conveys the printhead. A conveyance motor 1709 conveys a print medium. A head driver 1705 drives the printhead IJH. A motor driver 1706 drives the conveyance motor 1709. A motor driver 1707 drives the carrier motor 1710.

The operation of the control arrangement will be described. When a print signal is input to the interface 1700, the print signal is converted into print data for printing between the gate array 1704 and the MPU 1701. The motor drivers 1706 and 1707 are driven. In addition, the printhead IJH is driven in accordance with the print data sent to the head driver 1705 so that printing is executed. An enable signal to be described later and a block control signal to control a driven block are also supplied to the printhead via the head driver.

[Head Cartridge]

Figure 12:
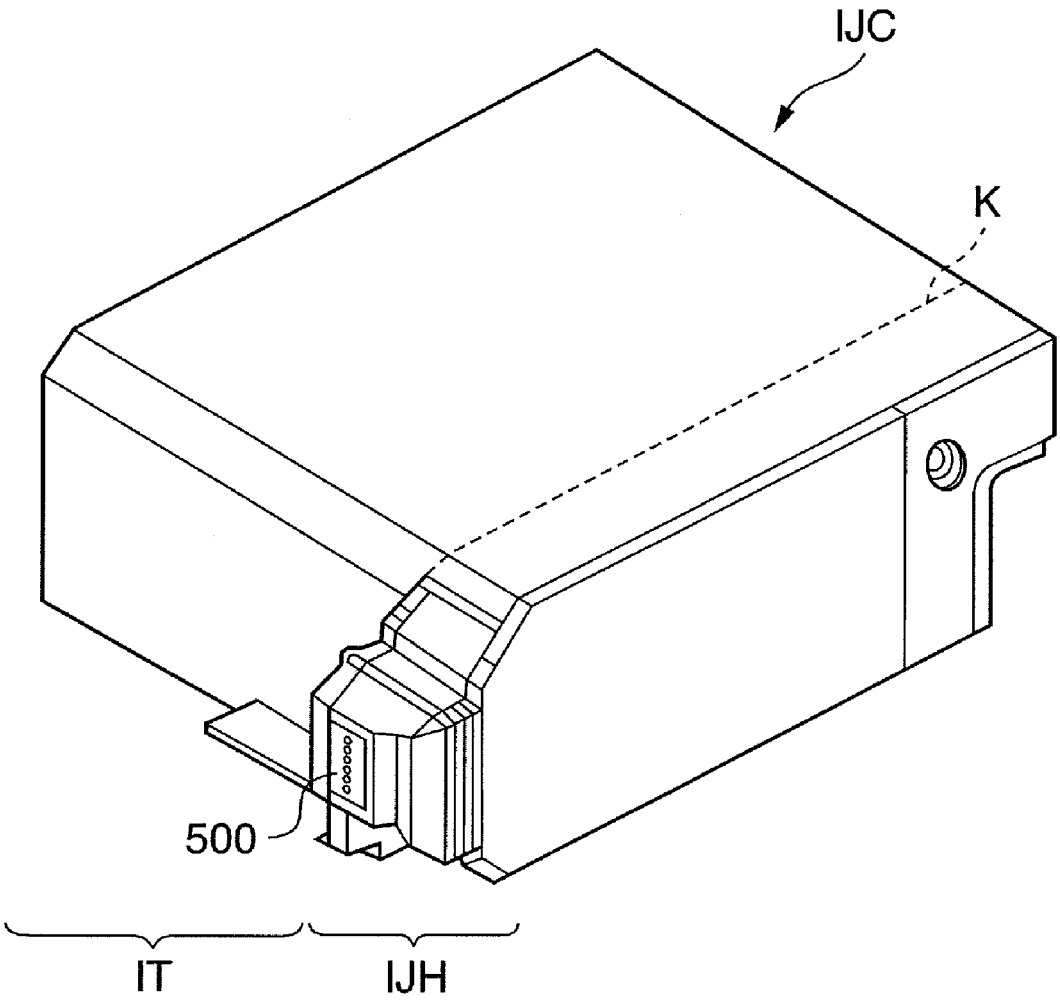
FIG. 12 is an external perspective view showing the arrangement of a head cartridge that integrates an ink tank and a printhead according to the embodiment of the present invention.

FIG. 12 is an external perspective view showing the arrangement of the head cartridge IJC that integrates the ink tank and printhead. Referring to FIG. 12, a dotted line K indicates the boundary between the ink tank IT and the printhead IJH. The head cartridge IJC has an electrode (not shown) to receive an electrical signal supplied from the side of the carriage HC when the head cartridge IJC is mounted on the carriage HC. The electrical signal drives the printhead IJH to discharge ink, as described above.

Reference numeral 500 in FIG. 12 denotes an ink discharge orifice array.

[Printhead]

The printhead according to the typical embodiment of the present invention will be described next.

Figure 2A:
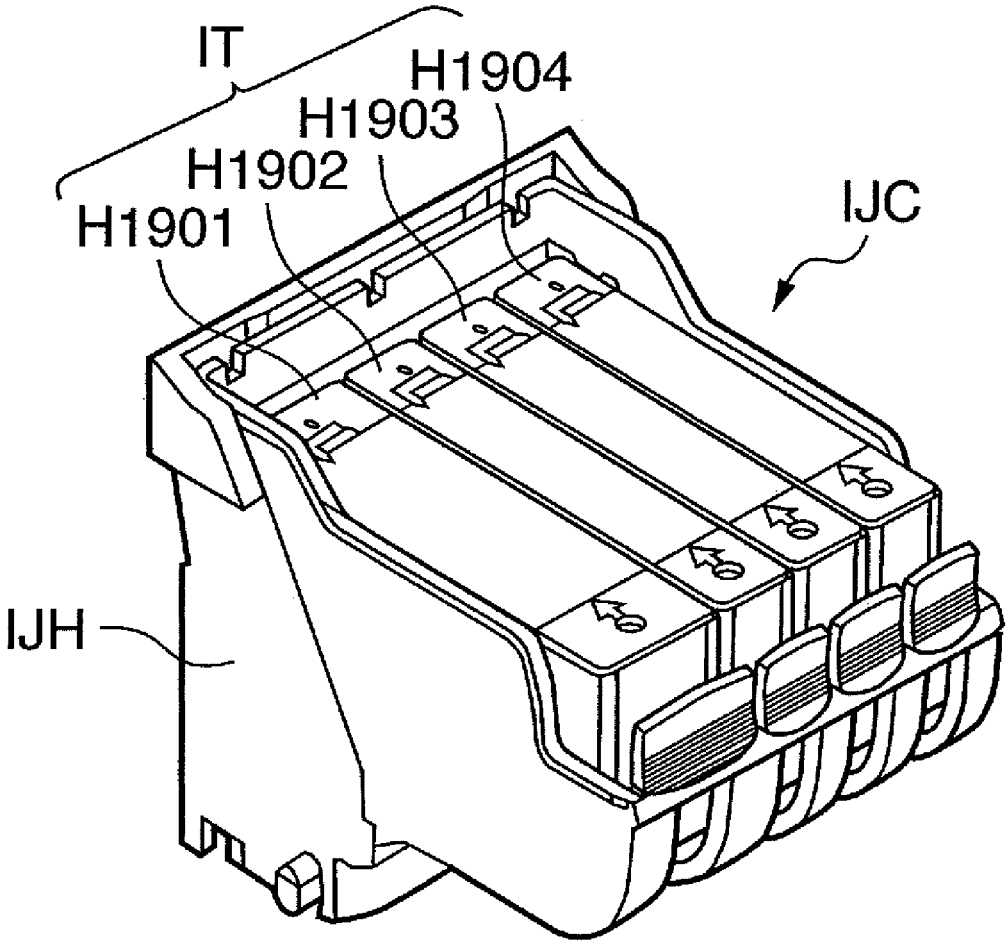
FIGS. 2A and 2B are views showing the arrangement of a head cartridge using an inkjet printhead according to the embodiment of the present invention.
Figure 2B:
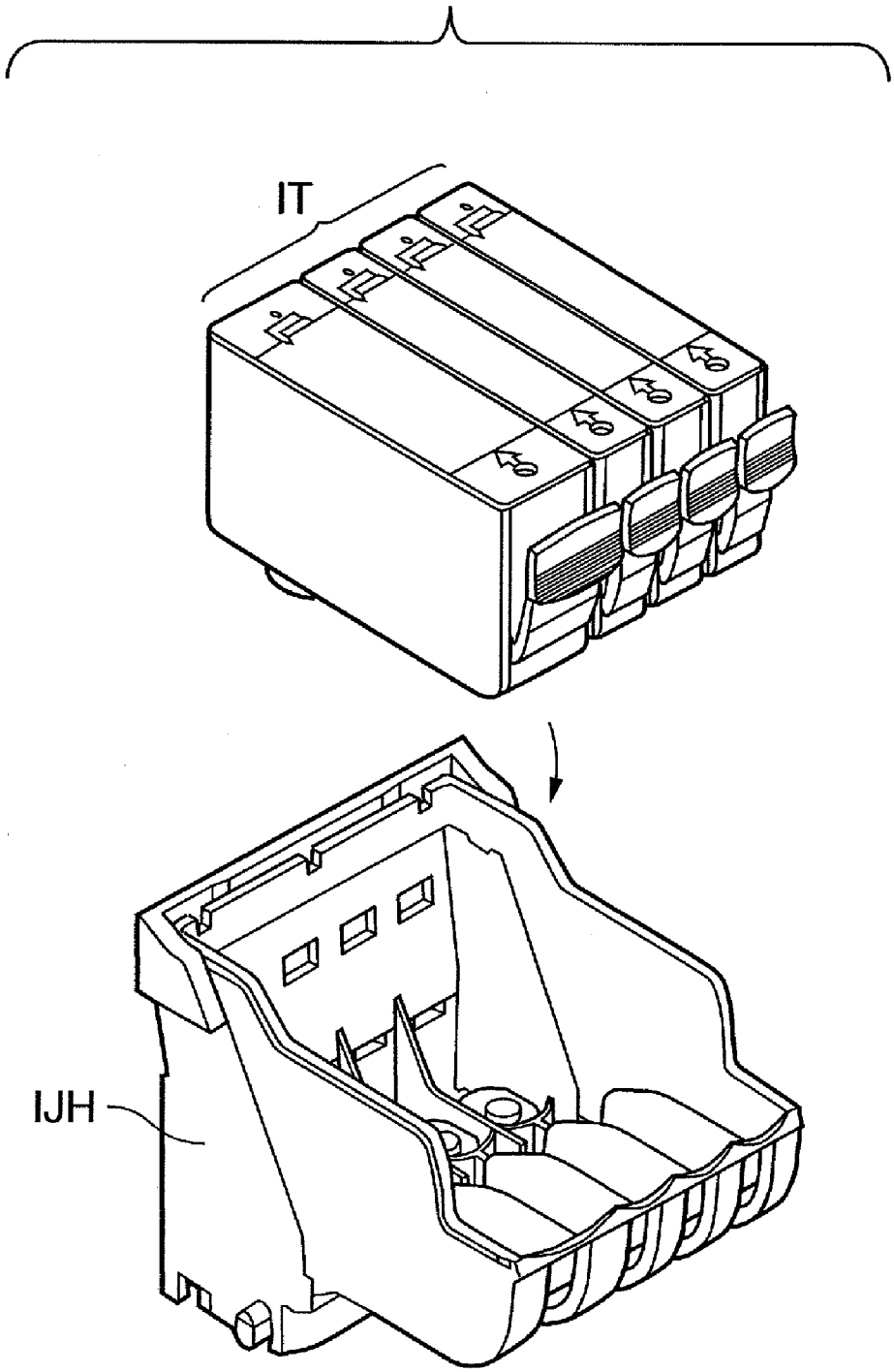

The printhead IJH of this embodiment is a constituent element of the head cartridge IJC, as is apparent from the perspective views in FIGS. 2A and 2B. The head cartridge IJC includes the printhead IJH and the ink tank IT (H1901 to H1904) detachably provided on the printhead IJH. The ink tank IT supplies ink (print liquids) to the printhead IJH, and the printhead IJH discharges the ink from the discharge orifices in accordance with the print information.

The positioning unit and electrical contacts of the carriage HC incorporated in the inkjet printing apparatus IJRA stationarily support the head cartridge IJC. The head cartridge IJC is detachable from the carriage HC.

Figure 3:
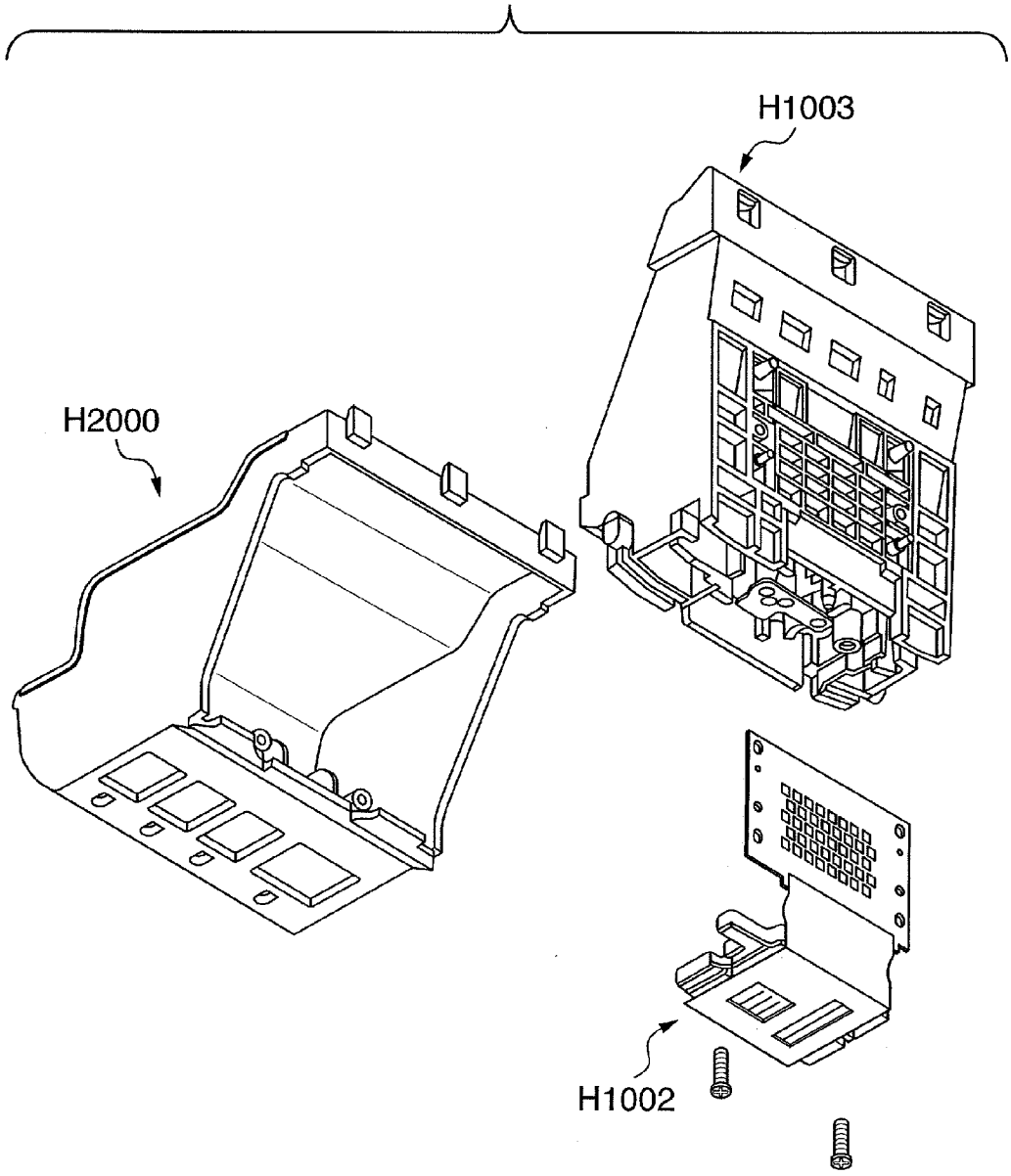
FIG. 3 is an exploded perspective view of the inkjet printhead according to the embodiment of the present invention.

The printhead IJH includes a printing element unit H1002, ink supply unit (print liquid supply unit) H1003, and tank holder H2000, as shown in the exploded perspective view of FIG. 3.

Figure 4:
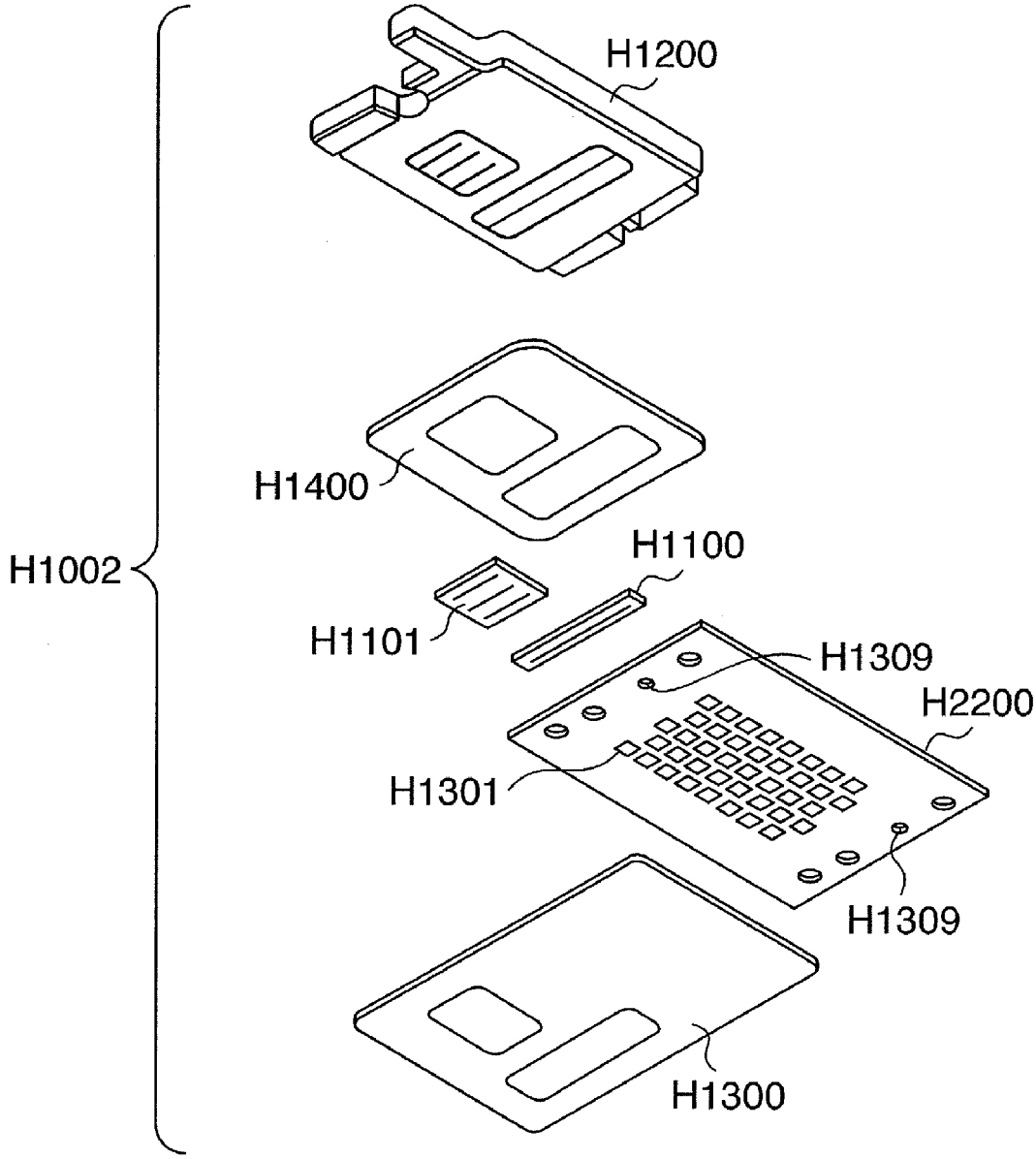
FIG. 4 is an exploded perspective view of a printing unit according to the embodiment of the present invention.

An element substrate H1100 is bonded and fixed on a first plate H1200, as shown in the exploded perspective view of FIG. 4. A second plate H1400 having opening portions is bonded and fixed on the first plate H1200. An electric wiring tape H1300 is bonded and fixed on the second plate H1400 by the TAB method. The electric wiring tape H1300 holds the positional relationship with respect to the element substrate H1100. The electric wiring tape H1300 has an electric wiring corresponding to the element substrate H1100 and applies an electrical signal for ink discharge to the element substrate H1100. The electric wiring tape H1300 is connected to an electric contact substrate H2200 having external signal input terminals H1301 to receive the electrical signal from the inkjet printing apparatus IJRA. The electric contact substrate H2200 is located and fixed on the ink supply unit H1003 by terminal locating holes H1309 (at two points).

Figure 5:
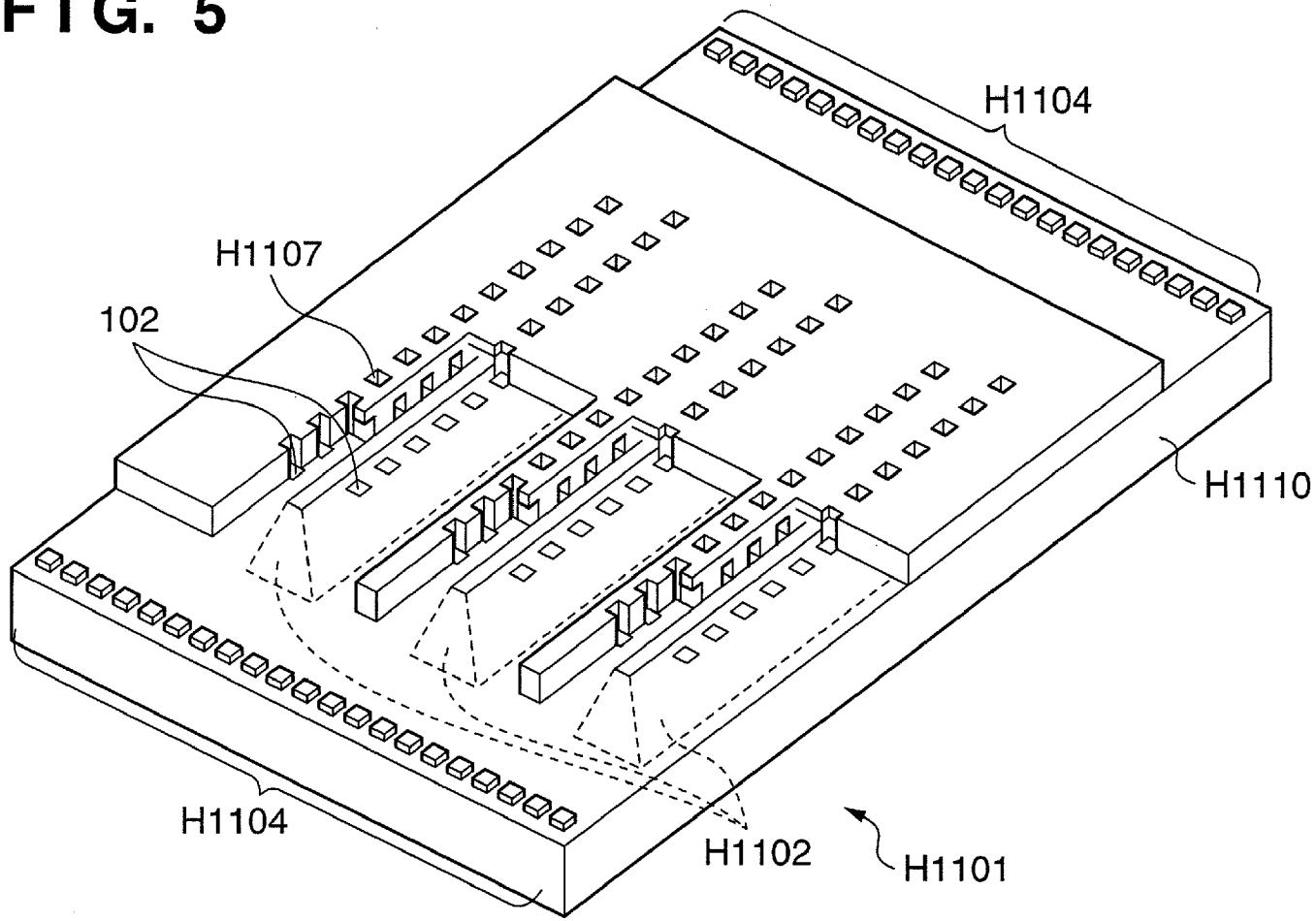
FIG. 5 is a partially cutaway perspective view for explaining the arrangement of an element substrate according to the embodiment of the present invention.

FIG. 5 is a partially cutaway perspective view for explaining the arrangement of a second element substrate H1101. The second element substrate H1101 is an element substrate to discharge three color inks. Common chambers having three ink supply ports H1102 are formed in parallel. Heaters 102 and ink discharge orifices H1107 are formed on both sides of each ink supply port H1102. Like the first element substrate H1100, an Si substrate H1110 has the ink supply ports H1102, heaters 102, electric wirings, and electrodes H1104. Ink channels and ink discharge orifices H1107 are formed on them by photolithography using a resin material.

The electric wiring tape H1300 applies an electrical signal for ink discharge to the first element substrate H1100 and second element substrate H1101. The electric wiring tape H1300 has electrode terminal portions electrically connected to the electric contact substrate H2200. The electric contact substrate H2200 has two opening portions to receive the first element substrate H1100 and second element substrate H1101, and electrode terminals (not shown) corresponding to the electrodes H1104 of the element substrates. The electric contact substrate H2200 also has the external signal input terminals H1301 which are provided at an end of the electric wiring tape H1300 to receive an electrical signal from the printing apparatus. The electric wiring tape H1300, first element substrate H1100, and second element substrate H1101 are electrically connected to each other.

The element substrate H1101 as an important part of the present invention will be described next in detail.

First Embodiment

Figure 1:
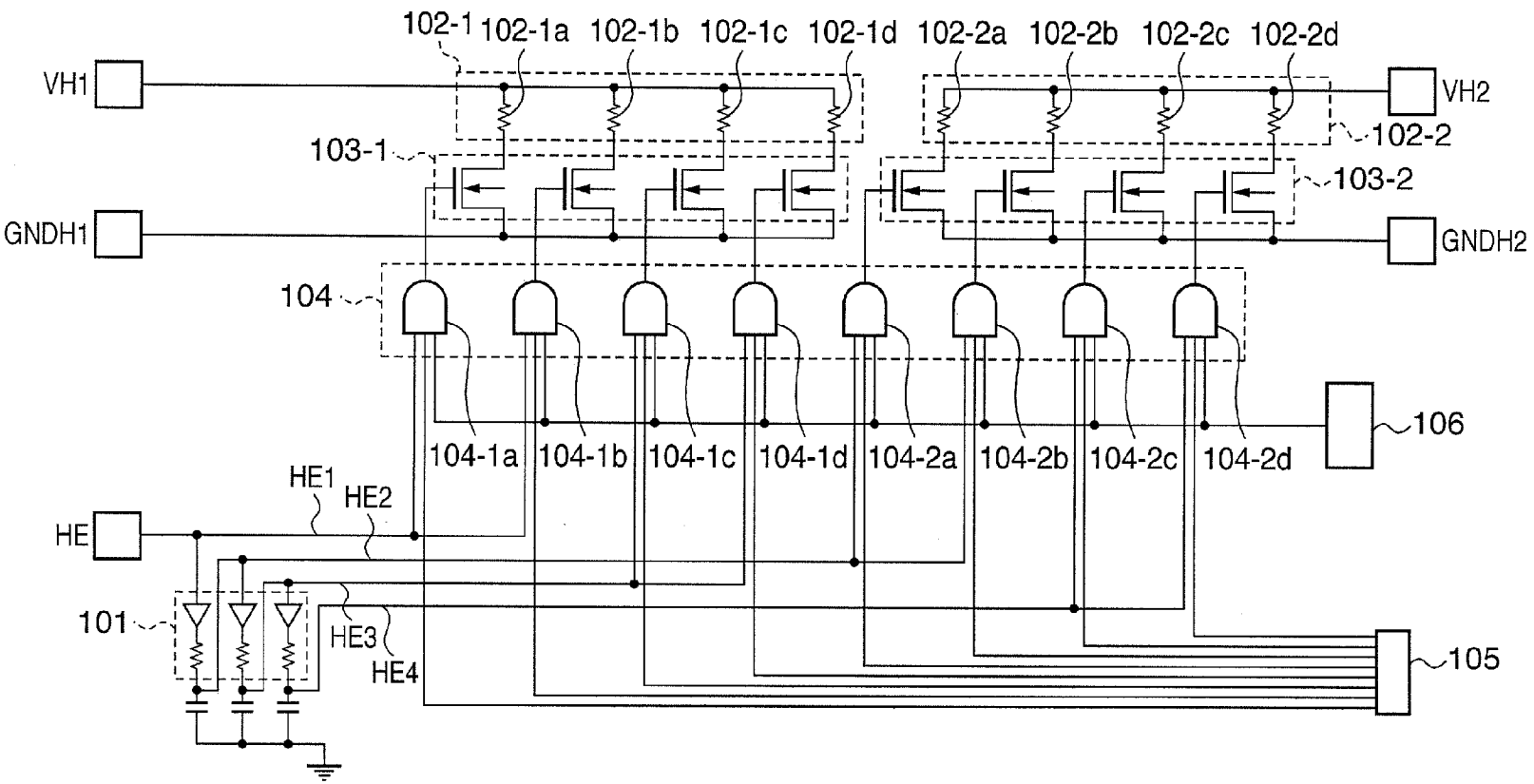
FIG. 1 is a circuit diagram showing heaters and their driving circuit according to the first embodiment.

FIG. 1 shows part of a circuit formed on the second element substrate H1101 of this embodiment. FIG. 1 is a circuit diagram showing heaters (printing elements) and their driving circuit. Referring to FIG. 1, an input terminal HE inputs a heat enable signal to a delay circuit 101, and the delay circuit 101 delays the heat enable signal. Heater groups 102-1 and 102-2 serve as printing elements to heat and discharge ink. Transistor groups 103-1 and 103-2 drive the heater groups 102-1 and 102-2. A control gate group 104 controls the transistor groups 103-1 and 103-2. A latch circuit 105 latches data to be sent to the transistor groups 103-1 and 103-2 via the control gate group 104. A block selection logic circuit 106 activates each control gate of the control gate group 104 in correspondence with a time-divided block.

The block selection logic circuit 106 including a decoder can sequentially designate a plurality of blocks. Only a circuit arrangement for selecting one block by the decoder is shown here for illustrative convenience.

When a plurality of blocks exist, input terminals VH1 and VH2 to input a power supply voltage and the input terminal HE to input a heat enable signal are commonly connected to the plurality of blocks.

An HE (Heat Enable) 1 signal enables a specific control gate of the control gate group 104 for a predetermined period. An HE2 signal is obtained by delaying the HE1 signal using the delay circuit 101. An HE3 signal is obtained by delaying the HE2 signal using the delay circuit 101. An HE4 signal is obtained by delaying the HE3 signal using the delay circuit 101. The input terminal VH1 is a bundle of driving power supply wirings to supply a driving voltage to the heater group 102-1. The input terminal VH2 is a bundle of driving power supply wirings to supply a driving voltage to the heater group 102-2. An electrode terminal GNDH1 is a bundle of ground wirings of the heater group 102-1. An electrode terminal GNDH2 is a bundle of ground wirings of the heater group 102-2.

Referring to FIG. 1, all heaters in the heater groups 102-1 and 102-2 selected by the block selection logic circuit 106 are driven. In this case, first, the input terminal HE inputs the HE1 signal to control gates 104-1*a* and 104-1*b* so that a driving pulse signal is input to heaters 102-1*a* and 102-1*b*. Next, the HE2 signal obtained by delaying the HE1 signal by a predetermined time using the delay circuit 101 is input to control gates 104-2*a* and 104-2*b* so that a driving pulse signal delayed by a predetermined time is input to heaters 102-2*a* and 102-2*b*. The HE3 signal obtained by delaying the HE2 signal by a predetermined time using the delay circuit 101 is input to control gates 104-1*c* and 104-1*d* so that a driving pulse signal delayed by a predetermined time is input to heaters 102-1*c* and 102-1*d*. Finally, the HE4 signal obtained by delaying the HE3 signal by a predetermined time using the delay circuit 101 is input to control gates 104-2*c* and 104-2*d* so that a driving pulse signal delayed by a predetermined time is input to heaters 102-2*c* and 102-2*d*. In this way, the heaters are driven in the order of 102-1*a* and 102-1*b*, 102-2*a* and 102-2*b*, 102-1*c* and 102-1*d*, and 102-2*c* and 102-2*d*.

According to this embodiment, the heaters of the heater group 102-1 which receives the driving voltage from the input terminal VH1 and the heaters of the heater group 102-2 which receives the driving voltage from the input terminal VH2 are alternately driven in the order of the delay times of the heat enable signal. That is, in this embodiment, the current that flows in driving the heaters never flows to a single input terminal continuously; it alternately flows to the input terminals VH1 and VH2.

Figure 7:
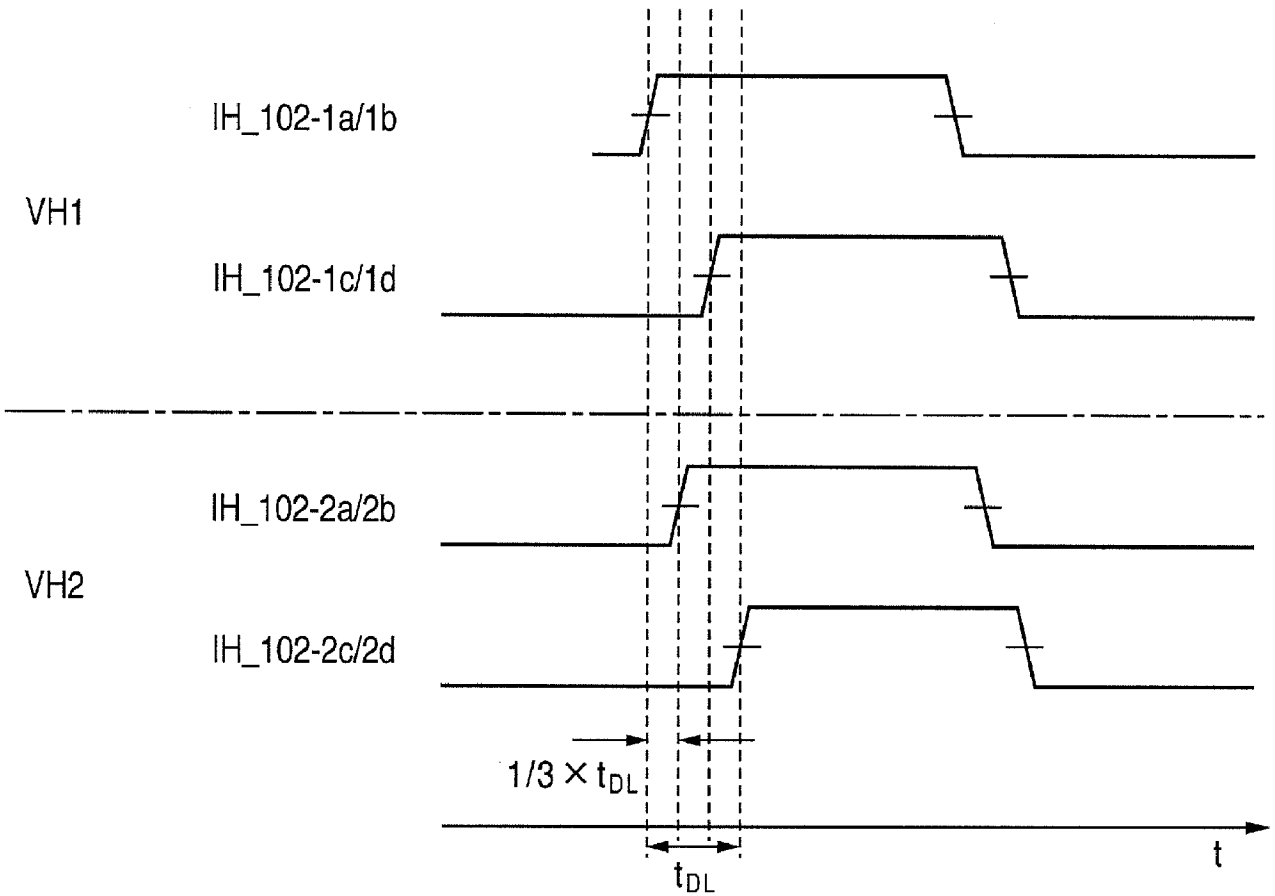
FIG. 7 is a timing chart showing the delays of a current flowing to heaters according to the first embodiment.

FIG. 7 is a timing chart showing the delays of the current flowing to the heaters according to this embodiment. First, a heater current IH_102-1*a*/1*b* flows to the heaters 102-1*a* and 102-1*b* which receive the driving voltage from the input terminal VH1. Then, ⅓×tDL sec later, a heater current IH_102-2*a*/2*b* flows to the heaters 102-2*a* and 102-2*b* which receive the driving voltage from the input terminal VH2. Another ⅓×tDL sec later, a heater current IH_102-1*c*/1*d* flows to the heaters 102-1*c* and 102-1*d* which receive the driving voltage from the input terminal VH1. Still another ⅓×tDL sec later, a heater current IH_102-2*c*/2*d* flows to the heaters 102-2*c* and 102-2*d* which receive the driving voltage from the input terminal VH2. All heaters are driven during tDL.

Second Embodiment

Figure 9:
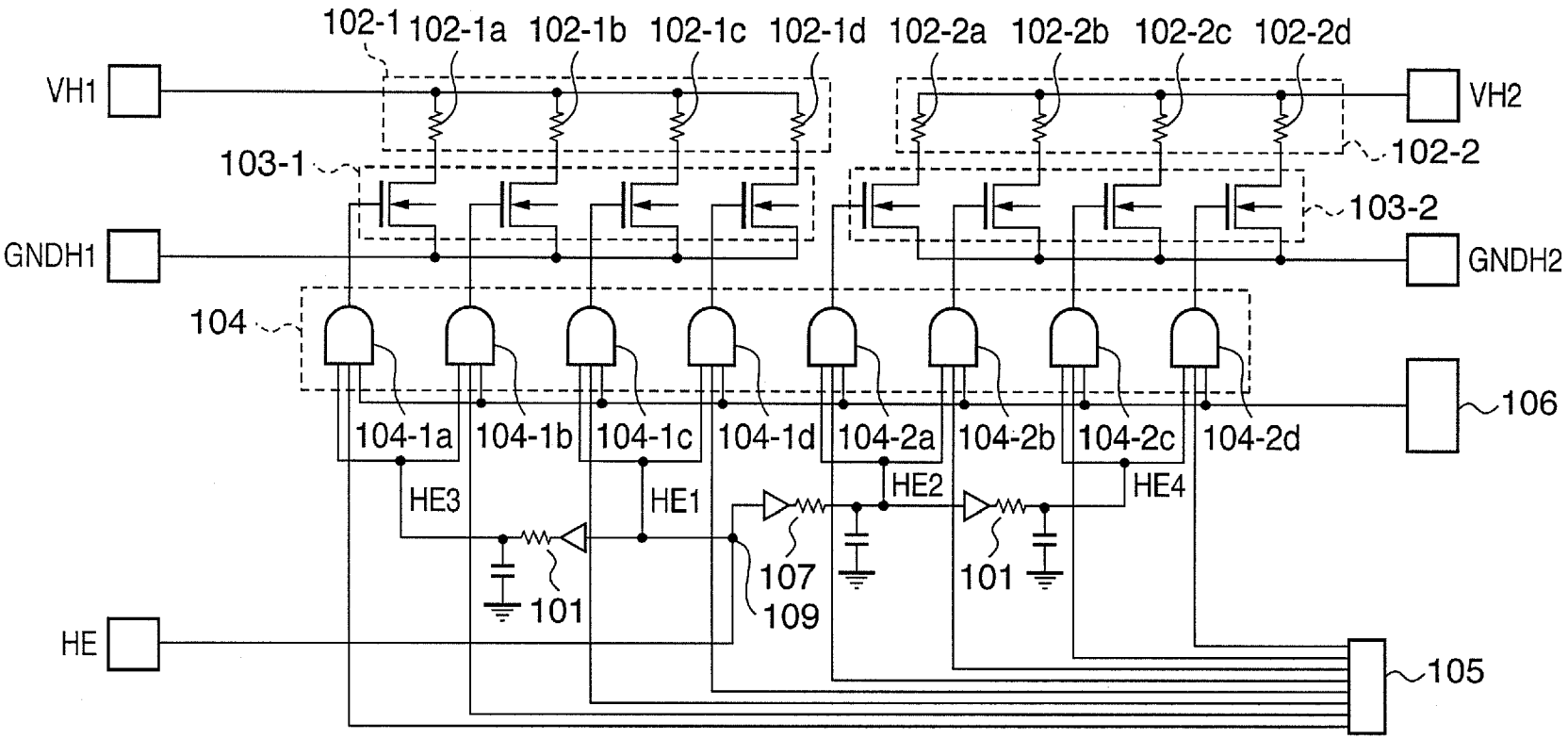
FIG. 9 is a circuit diagram showing heaters and their driving circuit according to the second embodiment.

FIG. 9 shows part of a circuit formed on an element substrate H1101 of this embodiment. FIG. 9 is a circuit diagram showing heaters (printing elements) and their driving circuit.

The signal line of a heat enable signal that enables a gate group 104 for a predetermined period branches at a node 109 to the side of an input terminal VH1 and the side of an input terminal VH2. Even in this embodiment, only a circuit for driving one block is illustrated, as in the first embodiment.

Of the heat enable signals distributed to the input terminals VH1 and VH2 at the node 109, the heat enable signal on the side of the input terminal VH2 is delayed by a delay circuit 107. An HE1 signal enables a specific gate of the gate group 104 for a predetermined period. An HE2 signal is obtained by delaying the HE1 signal using the delay circuit 107. An HE3 signal is obtained by delaying the HE1 signal by a delay circuit 101 for delaying the enable signal. An HE4 signal is obtained by delaying the HE2 signal using the delay circuit 101.

Referring to FIG. 9, all heaters in heater groups 102-1 and 102-2 are driven. In this case, first, an input terminal HE inputs the HE1 signal to gates 104-1*c* and 104-1*d* so that a driving pulse signal is input to heaters 102-1*c* and 102-1*d*. Next, the HE2 signal obtained by delaying the HE1 signal by a predetermined time using the delay circuit 107 is input to gates 104-2*a* and 104-2*b* so that a driving pulse signal delayed by a predetermined time is input to heaters 102-2*a* and 102-2*b*. The heat enable signal delayed time of the delay circuit 107 is shorter than that of the delay circuit 101. The HE3 signal obtained by delaying the HE1 signal by a predetermined time using the delay circuit 101 is input to gates 104-1*a* and 104-1*b* so that a driving pulse signal delayed by a predetermined time is input to heaters 102-1*a* and 102-1*b*. Finally, the HE4 signal obtained by delaying the HE2 signal by a predetermined time using the delay circuit 101 is input to gates 104-2*c* and 104-2*d* so that a driving pulse signal delayed by a predetermined time is input to heaters 102-2*c* and 102-2*d*. In this way, the heaters sequentially receive the heat enable signals in ascending order of distance to the node 109. When the delay time of the delay circuit 107 is ½ that of the delay circuit 101, the heat enable signals delayed at equal time intervals are input to the heaters. The heaters are driven in the order of 102-1*c* and 102-1*d*, 102-2*a* and 102-2*b*, 102-1*a* and 102-1*b*, and 102-2*c* and 102-2*d*.

According to this embodiment, the heaters of the heater group 102-1 which receives the driving voltage from the input terminal VH1 and the heaters of the heater group 102-2 which receives the driving voltage from the input terminal VH2 are alternately driven in the order of the delay times. That is, in this embodiment, the current that flows in driving the heaters never flows to a single input terminal continuously; it alternately flows to the input terminals VH1 and VH2. In this embodiment, the number of heaters on the side of the input terminal VH1 equals that on the side of the input terminal VH2. Hence, the signal line of the heat enable signal is branched at the node 109 so that the divided lines have the same or almost equal lengths on the sides of the input terminals VH1 and VH2. This makes it possible to drive the heaters sequentially at a predetermined time interval without any influence of the difference in wiring length.

Comparative Example

Figure 6:
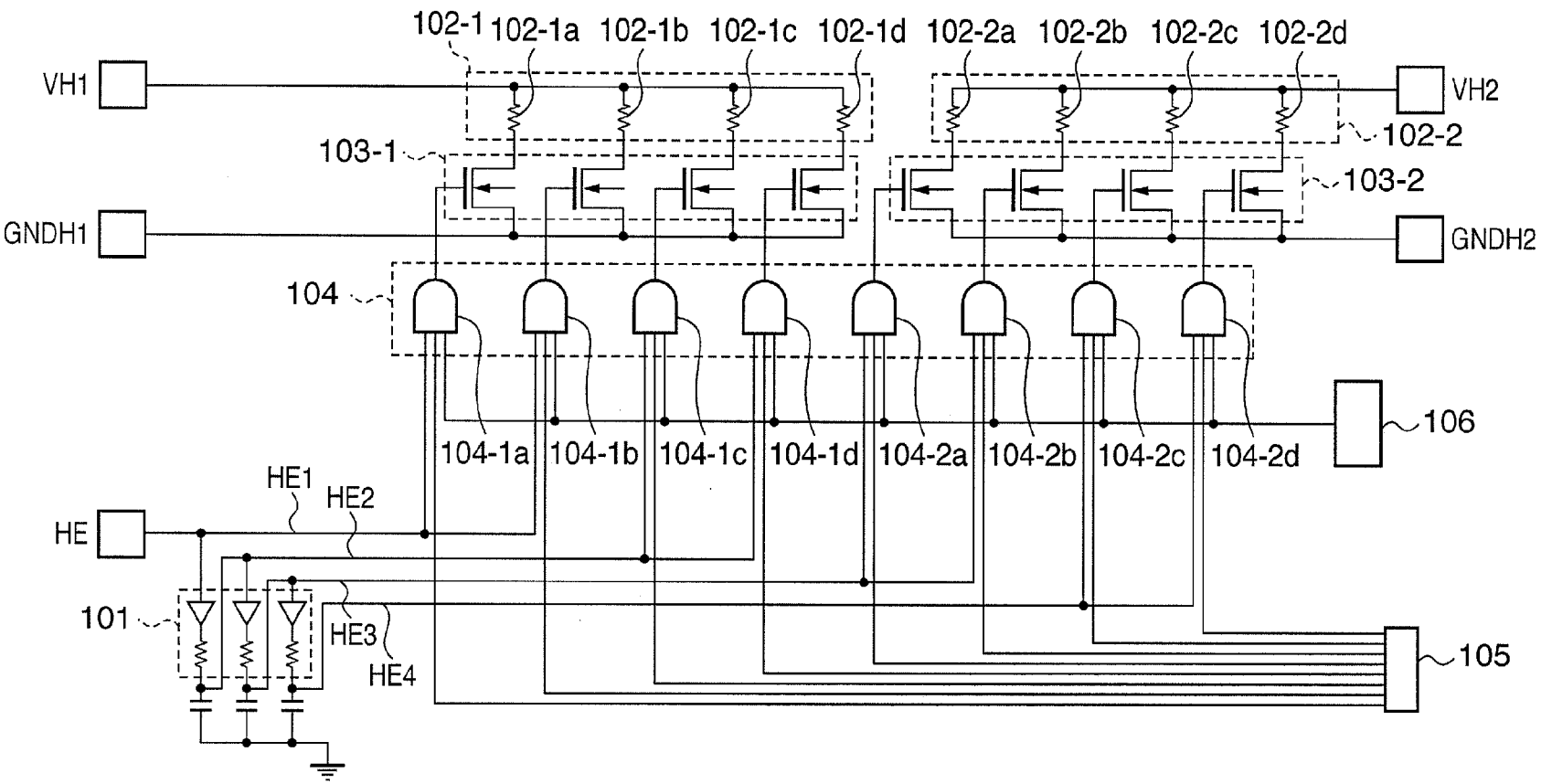
FIG. 6 is a circuit diagram showing heaters and their driving circuit examined by the present inventors for the present invention.

FIG. 6 is a circuit diagram showing a comparative example to the above-described embodiments. Referring to FIG. 6, all heaters in the heater groups 102-1 and 102-2 selected by the block selection logic circuit 106 are driven. In this case, first, the input terminal HE inputs the HE1 signal to the control gates 104-1*a* and 104-1*b* so that a driving pulse signal is input to the heaters 102-1*a* and 102-1*b*. Next, the HE2 signal obtained by delaying the HE1 signal by a predetermined time using the delay circuit 101 is input to control gates 104-1*c* and 104-1*d* so that a driving pulse signal delayed by a predetermined time is input to heaters 102-1*c* and 102-1*d*. The HE3 signal obtained by delaying the HE2 signal by a predetermined time using the delay circuit 101 is input to control gates 104-2*a* and 104-2*b* so that a driving pulse signal delayed by a predetermined time is input to heaters 102-2*a* and 102-2*b*. Finally, the HE4 signal obtained by delaying the HE3 signal by a predetermined time using the delay circuit 101 is input to control gates 104-2*c* and 104-2*d* so that a driving pulse signal delayed by a predetermined time is input to heaters 102-2*c* and 102-2*d*. In this way, the heaters are driven in the order of 102-1*a* and 102-1*b*, 102-1*c* and 102-1*d*, 102-2*a* and 102-2*b*, and 102-2*c* and 102-2*d*.

Figure 8A:
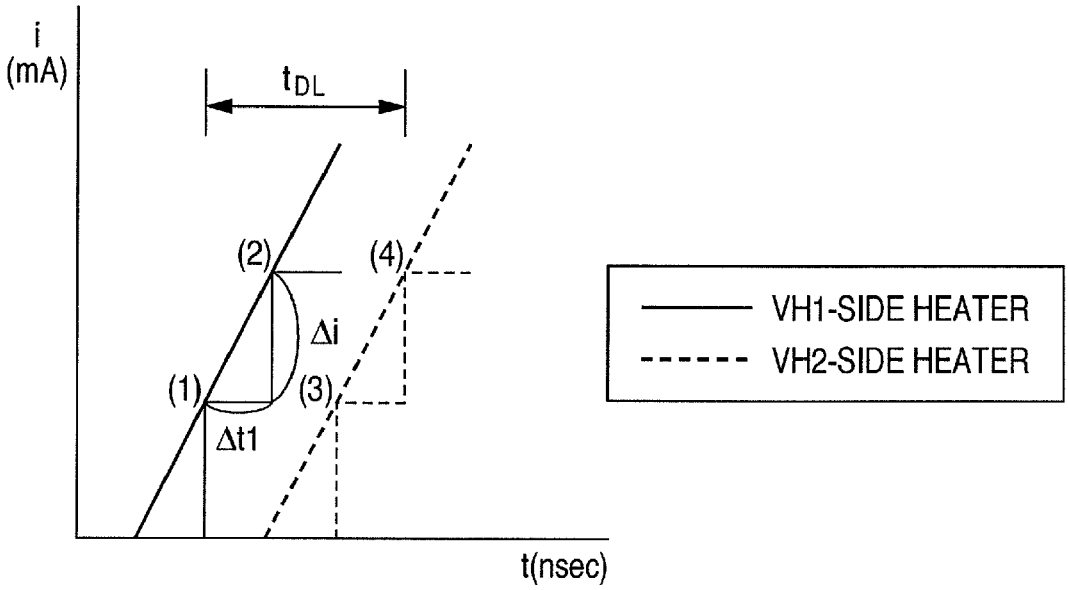
FIGS. 8A and 8B are graphs showing the rises of currents flowing to driving power supply wirings.
Figure 8B:
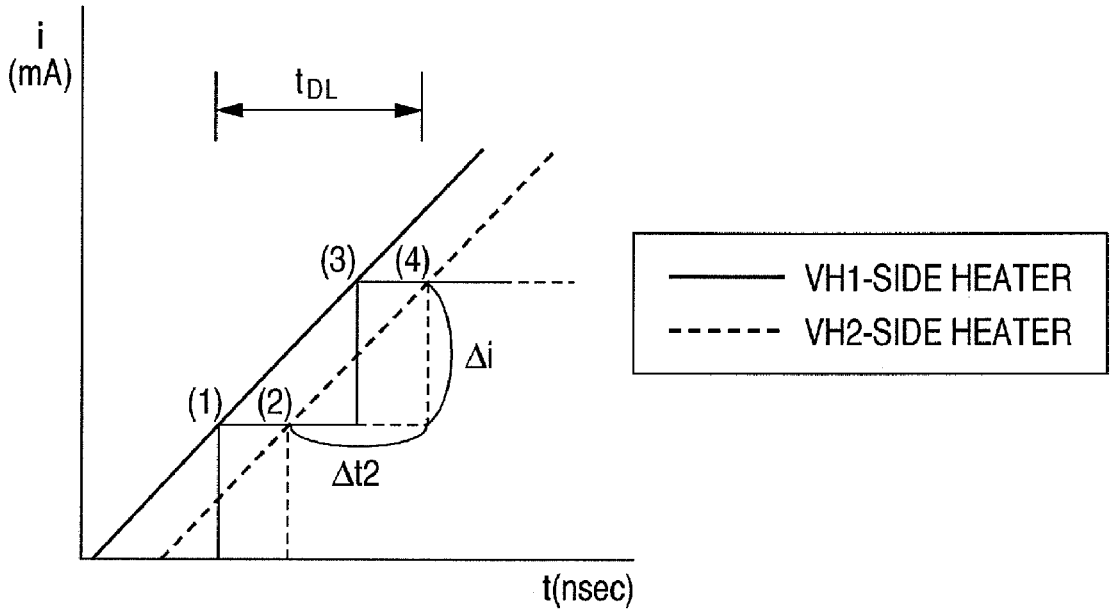

FIGS. 8A and 8B are graphs showing the rises of currents flowing to the driving power supply wirings. In FIGS. 8A and 8B, let Δi be the current flowing to the input terminals VH1 and VH2 in driving one set of heaters, Δt1 be the delay time, and tDL be the total delay time from the first heater driving to the last heater driving.

FIG. 8A is a graph showing the rises of currents when the heaters and their driving circuit of the comparative example are used. First, the heaters which receive the driving voltage from the input terminal VH1 are driven. The delay time Δt1 later, the heaters which also receive the driving voltage from the input terminal VH1 are driven. That is, all heaters which receive the driving voltage from the input terminal VH1 are driven. Another delay time Δt1 later, the heaters which receive the driving voltage from the input terminal VH2 are driven in the same way of driving.

FIG. 8B is a graph showing the rises of currents when the heaters and their driving circuit according to the first and second embodiments are used. First, the heaters which receive the driving voltage from the input terminal VH1 are driven. The delay time Δt1 later, the heaters which receive the driving voltage from the input terminal VH2 are driven. Another delay time Δt1 later, the heaters which receive the driving voltage from the input terminal VH1 are driven. Finally, still another delay time Δt1 later, the heaters which receive the driving voltage from the input terminal VH2 are driven.

In the first and second embodiments, the heaters which receive the driving voltage from the input terminal VH1 and those which receive driving voltage from the input terminal VH2 are alternately driven. Hence, a delay time Δt2 for each of the input terminals VH1 and VH2 is twice the delay time Δt1.

According to the first and second embodiments, it is possible to halve the rise of the current flowing to a driving power supply wiring on the TAB wiring without changing the total delay time.

In both embodiments, the element substrate has the two input terminals to supply the driving voltage to the heater. The element substrate may have a plurality of input terminals (three or more terminals).

In both embodiments, each of the heater groups which receive the driving signals delayed by the delay circuit in a predetermined number of steps includes two heaters. However, the number of heaters included in each heater group may be 1 or 3 or more.

In both embodiments, the element substrate uses heaters as printing elements. The element substrate may use, e.g., piezoelectric elements as printing elements.

In the present invention, the number of heaters to be driven in one block is not limited. It is therefore possible to obtain optimum conditions by combining the delay time, the number of blocks, the number of heaters to be driven in one block, and the like in an element substrate with heaters being arranged at a high density.

As described above, even when the number of heaters to be driven increases, the present invention allows to suppress the rise of a current flowing to an input terminal for supplying a driving voltage to the heaters. Hence, it is possible to prevent noise generation on TAB electric wirings due to the rise of a current flowing to driving power supply wirings and prevent operation errors of a logic circuit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-296944, filed Oct. 31, 2006, which is hereby incorporated by reference herein in its entirety.

What is claimed is:

1. An element substrate comprising:

a printing element array including a plurality of printing elements and performing a printing operation by an energization, the printing elements being divided into four groups of a first group, a second group, a third group and a fourth group;

a plurality of transistors being respectively disposed in correspondence with the printing elements of the printing element array, and controlling ON/OFF for energizing the printing elements based on driving pulse signal;

a pair of first electrode pads applying voltage for energizing a plurality of printing elements belonging to the first group and a plurality of printing elements belonging to the second group;

a pair of second electrode pads applying voltage for energizing a plurality of printing elements belonging to the third group and a plurality of printing elements belonging to the fourth group;

a driving circuit outputting a driving signal for driving the printing elements of the printing element array;

an output circuit outputting four different enable signals to the four groups respectively, the four enable signals being used for determining an energization time for energizing the printing elements of the printing element array; and a control circuit outputting the driving pulse signal to the plurality of transistors, the driving plus signal being generated based on the driving signal and the four enable signals, wherein the output circuit outputs the four enable signals to input in the order of the first group, the third group, the second group and the fourth group.

2. The substrate according to claim 1, wherein the output circuit includes a delayed circuit which generates the four enable signals which have different generation timing from one other by delaying pulse of an input enable signal input from a terminal.

3. The substrate according to claim 1, wherein the first group and the second group are disposed adjacently, and the third group and the fourth group are disposed adjacently.

4. The substrate according to claim 1, wherein each of the printing elements includes a heater which generates thermal energy to discharge liquid by an energization.

5. An inkjet printhead including the element substrate according to claim 1.

6. A printing apparatus including the inkjet printhead according to claim 5.

* * * * *